US005079838A

United States Patent [19]

Stallings, Jr.

[11] Patent Number: 5,079,838

[45] Date of Patent: Jan. 14, 1992

[54] BOTTLE OPENER

[76] Inventor: James W. Stallings, Jr., 2704 Kempsford Pl., Raleigh, N.C. 27604

[21] Appl. No.: 655,637

[22] Filed: Feb. 14, 1991

Related U.S. Application Data

[63] Continuation-in-part of Ser. No. 549,751, Jul. 9, 1990.

[51] Int. Cl.[5] ..... B67B 7/00

[52] U.S. Cl. ..... 30/1.5; 30/123; 30/359

[58] Field of Search ..... 30/1.5, 123, 258, 278, 30/359, 366, 112, 90.1, 233, 90.8; 7/138, 142, 158; 81/64

[56] References Cited

U.S. PATENT DOCUMENTS 3,092,906 6/1963 Deering ..... 30/90.8 X 4,158,914 6/1979 Kurtz ..... 30/233

*Primary Examiner*—Douglas D. Watts

*Attorney, Agent, or Firm*—Rosenthal & Putterman

[57] ABSTRACT

A bottle opener for cutting open thermoplastic bottle caps is disclosed. The bottle opener includes a first arm having a proximal end and a distal end, the first arm including at least one transverse aperture. A second arm includes a proximal end and a distal end, the second arm mounting a cutting blade. The first and second arms are joined together at their respective proximal ends and are normally urged apart into an inoperative mode and when urged together into a cutting mode, the cutting blade is moved into a cutting position that traverses the aperture and cuts the top off of a bottle resting therein.

21 Claims, 3 Drawing Sheets

BOTTLE OPENER

This application is a continuation-in-part of U.S. patent application Ser. No. 549,751, filed July 9, 1990.

FIELD OF THE INVENTION

This invention relates generally to the field of bottle openers and more specifically to bottle openers used for cutting the tops of thermoplastic bottles

BACKGROUND OF THE INVENTION

In the cosmetic and pharmaceutical industries it is common practice to package liquids such as lotions, jellies and creams in thermoplastic containers or in containers having thermoplastic caps. Many of these liquids are intended to be dispersed by the drop or in a fluid stream. As a result, the caps are designed with an integral fluid flow channel that is exposed when the top of the cap is cut off.

This type of storage bottle is extensively used in the hair styling industry for the storage of permanent wave solutions which have a high ammonia content. It is current practice to open "perm" bottles with an open-faced industrial type razor blade, or a pair of scissors, or by employing a needle to puncture a hole in the top of the cap. However, all of the foregoing methods of opening a perm bottle cause the metal of the opener to come into contact with the ammonia in the solution which causes the opener to rust. This is undesirable as children are often present at the hair stylist and could, therefore, accidentally come into contact with sharp implements and also because rusted cutting tools can cause tetanus if the skin is accidentally punctured.

It is accordingly an object of the invention to provide a bottle opener which is safe and convenient to use.

Another object of the present invention is to provide a bottle opener which is sanitary in operation.

A still further object of the invention is to provide a bottle opener having a hidden cutting edge.

Yet another object of the invention is to provide a bottle opener which is inexpensive.

SUMMARY OF THE INVENTION

The benefits and advantage of the present invention are achieved in a bottle opener for cutting open bottle caps. The bottle opener includes a first arm having a proximal end and a distal end, the first arm including at least one transverse aperture. A second arm is provided and includes a second proximal end and a second distal end, the second arm mounting a cutting blade. The first and second arms are joined together at their respective proximal ends and are normally urged apart into an inoperative mode and when urged together into a cutting mode, the cutting blade is moved into a cutting position that transverses said aperture. Thus, when a bottle cap is placed within the aperture when the first and second arms are in the inoperative mode and when the first and second arms are moved to the cutting mode, the cutting blade moves into cutting contacting relation with the bottle cap thereby cutting the bottle cap open.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENTS

Figure 2:
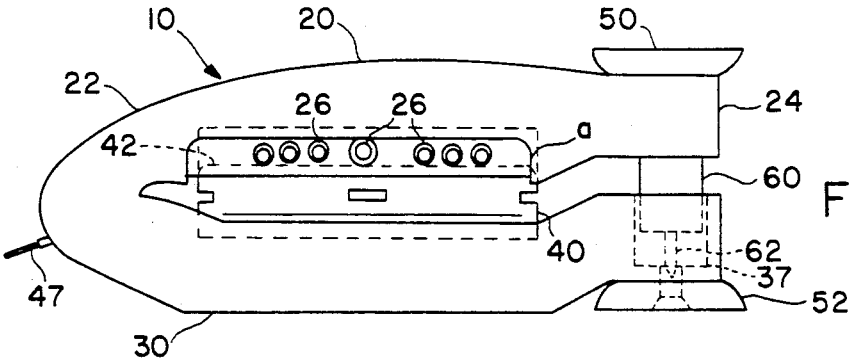
FIG. 2 is a side view showing the bottle opener of the present invention in the inoperative mode.

While the present invention will be described more fully hereinafter with reference to the accompanying drawings, in which particular embodiments are shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Referring now more particularly to the drawings and specifically to FIGS. 1 through 4, the bottle opener 10 of the present invention is therein depicted. The device can be used to cut open and to puncture the seals found on a variety types of containers C.

The bottle opener 10 comprises a pair of substantially similar arms 20,30. The arms are preferably manufactured out of flexible, resilient plastics such as acetal, polyacetal, polyethylene, polypropelene, nylon, polyester (P.E.) and glass or mineral filled derivatives thereof, and the like. However, the reader will note that other materials may also be employed with equal efficacy.

The first arm has a proximal end 22 and a distal end 24 and includes a plurality of spaced apart apertures 26 that extend transversely therethrough. A slot 28 extends longitudinally along the first arm 20 and is defined by the apertures 26 between opposing sides of the first arm.

The first arm 20 is an elongate section of plastic approximately 3–5 inches in length. The distal end 24 is slightly enlarged as compared to the proximal end. In addition, the section of the arm 20 is narrower in the area near the apertures 26, as will be explained more fully hereinbelow.

The apertures 26 are located on the first arm 20 in the central portion thereof and extend transverse to the longitudinal axis of the arm. Depending on the user's requirements, the bottle opener 10 of the present invention may include from one to several apertures which may also vary in diameter. In the illustrated embodiment, the apertures may be regarded as being divided into two groups, the first being closer to the proximal end of the arm and the second being closer to the distal end of the arm 20. These two groups of apertures are offset from one another so that when a razor blade 40, described in detail hereinbelow, is removed and is rotated 180 degrees, the cutting edge 42 of the blade that was previously in cutting contact with the bottle cap is now located between adjacent apertures 26 and is now inactive. Similarly, the portion of the razor blade that was previously positioned between apertures is now positioned immediately beneath apertures in a cutting position. In this manner, the life of the razor blade may be extended if so desired.

The first arm 20 includes a slot 28 extending longitudinally along the central portion of the arm and is defined by the apertures 26 between opposing sides of the first arm. As illustrated, the slot 28 is long enough to accommodate the entire length of the razor blade and has a depth that allows the razor blade to transverse the aperture 26 having the largest diameter. In addition, a gripping means 50 is operatively associated with the distal end 24 of the first arm 20 and preferably takes the form of an integrally molded platform.

The second arm 30 also includes a second proximal end 32 and a second distal end 34. A groove means or groove 36 extends longitudinally along the second ar and is adapted to mount a cutting blade means 40 having a cutting edge 42. In the preferred embodiment, the cutting blade means 40 comprises a conventional industrial razor blade and is designed to be pressure fitted within the groove and to be interchangeable when the razor blade wears out. In addition, a gripping means 52 is operatively associated with the distal end 34 of the second arm 30 and preferably takes the form of an integrally molded platform.

Figure 6:
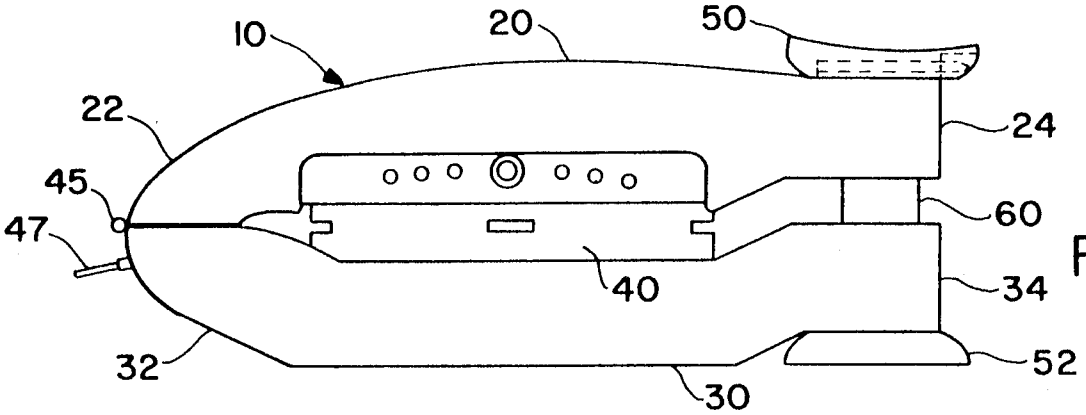
FIG. 6 is a side view of a second embodiment of the bottle opener of the present invention.
Figure 7:
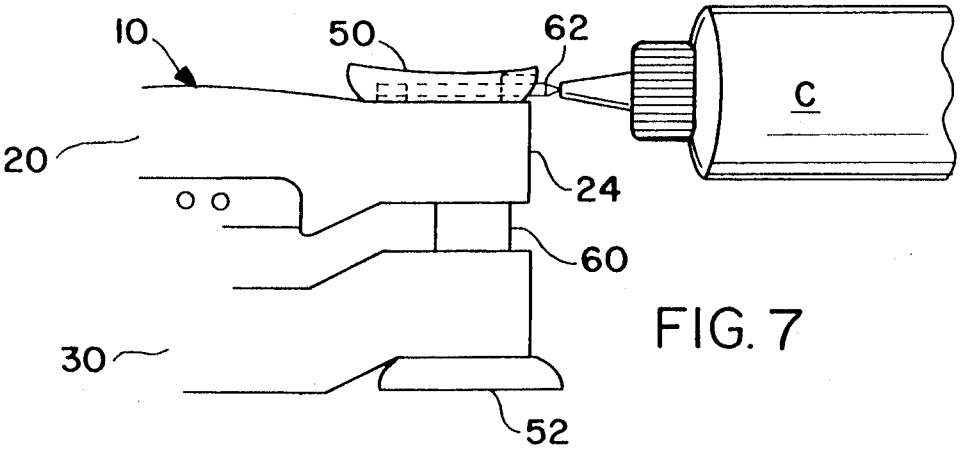
FIG. 7 is a partial side view of a second embodiment of the invention showing a bottle being opened using the puncture means.
Figure 5:
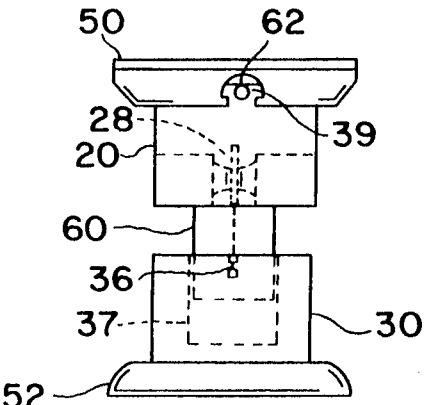
FIG. 5 is a front view of a second embodiment of the bottle opener of the present invention.

The proximal ends 22,32 of the respective first and second arm are joined together. In the illustrated embodiment, the first and second arms 20,30 are molded as a unit out of flexible resilient plastics as heretofore mentioned. However, it will be noted that the first and second arms 20,30 may also be joined together by employing other means such as a hinge 45 (as shown in FIG. 6), rivet, screw, and other equivalents in combination with butterfly springs, etc. which bias the arms apart. A hanging means or loop 47 is provided near the proximate end of the second arm 30.

Figure 1:
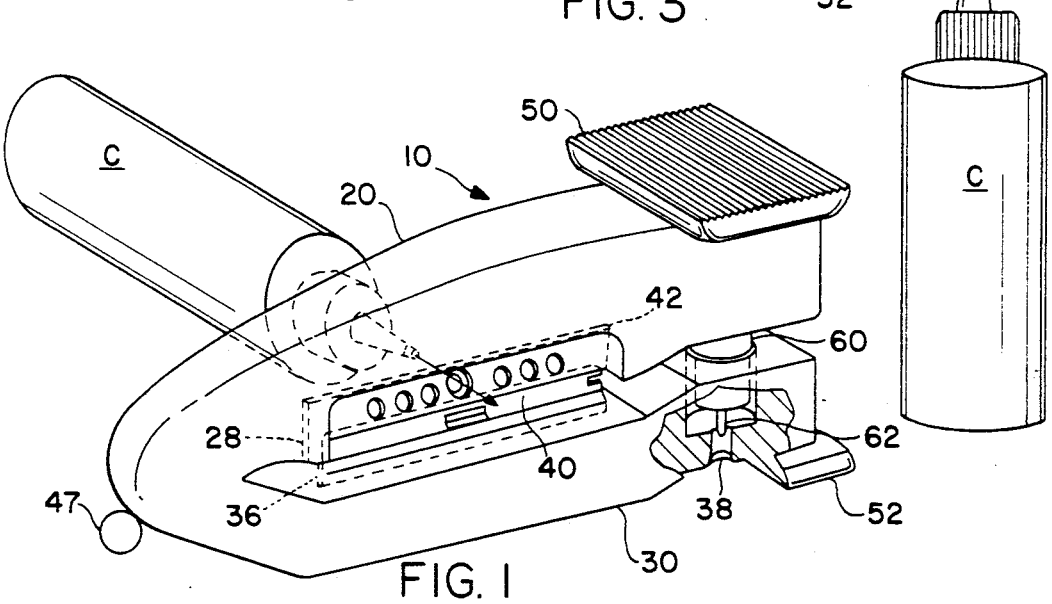
FIG. 1 is a perspective view, partially broken away of the bottle opener of the present invention.
Figure 4:
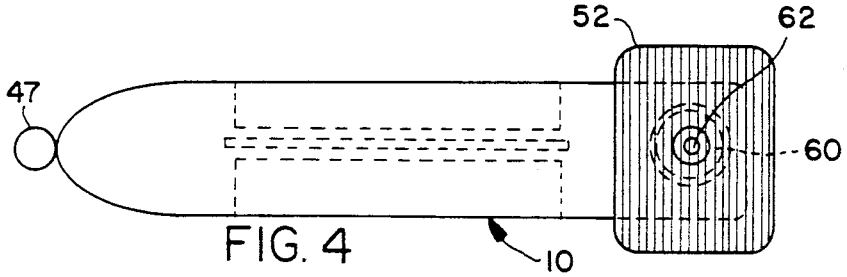
FIG. 4 is a plan view of the bottle opener of the present invention.

The first and second arms 20,30 are molded or otherwise biased to be normally urged apart into a inoperative mode wherein the cutting edge 42 of the cutting blade means 40 is positioned within the slot 28 (as shown in FIG. 1 and by the dotted line a in FIG. 2 . When the first and second arms are urged together into a cutting mode, the cutting edge 42 of the cutting means is moved into a cutting position that traverses the aperture 26 as shown by the dotted line b in FIG. 3.

In operation, the bottle opener 10 is gripped in the palm of the hand with the thumb positioned on one of the gripping means 50 and the forefinger is positioned on the other gripping means 52. The bottle to be opened is then grasped with the free hand and the cap C to be cut is placed within the aperture 26 having a diameter that most closely matches the diameter of the cap to be cut. The first and second gripping means are then urged together into a cutting mode wherein the cutting edge 42 of the cutting means 40 is moved into a cutting position (as shown by the letter b in FIG. 3) that traverses the aperture 26. When the cap has been completely cut off, the pressure on the first and second arms is released returning them to the inoperative mode and the bottle is removed from the aperture.

Figure 3:
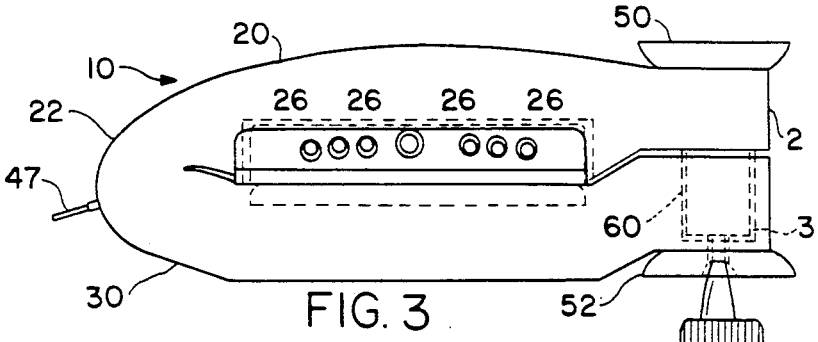
FIG. 3 is a side view showing the bottle opener of the present invention in the cutting mode and further illustrating the bottle being opened with the puncture means.

The bottle opener 10 also includes the capability to open containers that are opened by puncturing a seal rather than by cutting off a portion of the cap. In a first embodiment of this opener, the distal end 24 of the first arm includes a protuberance 60 that extends downwardly towards the distal end of the second arm. Mounted centrally within the protuberance 60 is a puncture means or pin 62 which also faces the opposing distal end 34 of the second arm. The second arm 30 includes a bore defining a channel 37 located near its distal end. As best illustrated in FIGS. 1 through 3, the channel 37 is divided into two sections, the upper section being of a diameter to accept the protuberance 60 and the lower section allowing for reciprocating movement of the puncture means 62. In addition, the channel 36 includes a counter sink or outwardly flared recess 38 at its terminating end. When the first and second arms 20,30 are in the inoperative mode, the puncture means 62 is in a first retracted position (as shown in FIG. 1) and when the first and second arms are urged together into the cutting mode, the puncture means 62 is moved into a second extended position (as shown in FIG. 3).

In operation, the container seal to be punctured is placed within the flared recess 38 and the first and second arm are urged together thereby moving the puncture means 62 from the retracted position to the extended position wherein the puncture means penetrates and punctures the container seal, thereby allowing the contents thereof to be dispensed. In this manner, the seal may be safely punctured without the likelihood of injury to the user as the puncture means 60 is located completely within the channel 37 in the second arm during the entire process.

In another embodiment of the invention, the puncture means 62 is mounted on the distal end of either of the arms, 20,30 however for illustration purposes only, the puncture means 62 is mounted on a track 39 integrally formed at the distal end 24 of the first arm 20 and protrudes a predetermined puncturing distance beyond the distal end thereof. The gripping means 50 is mounted so as to cover the entire puncture means 62 when in the inoperative position and to be retractable to a second puncturing position wherein the projecting end of the puncture means is exposed.

In operation, the bottle opener is gripped in the palm of the hand and the thumb is positioned on the gripping means 50,52. The container including seal to be punctured is brought into proximity with the puncture means 62 and the same is exposed by retracting the gripping mean with the thumb. The seal and the puncture means are then brought into contact so that puncture means penetrates the seal. The puncture means and the container are then pulled apart and the gripping means is then extended to cover the puncture means.

Figure 8:
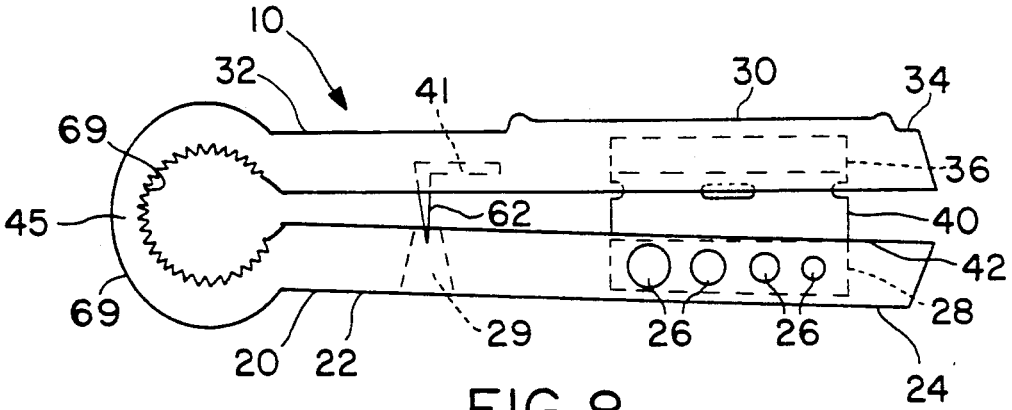
FIG. 8 is a side view of a third embodiment of the present invention.
Figure 9:
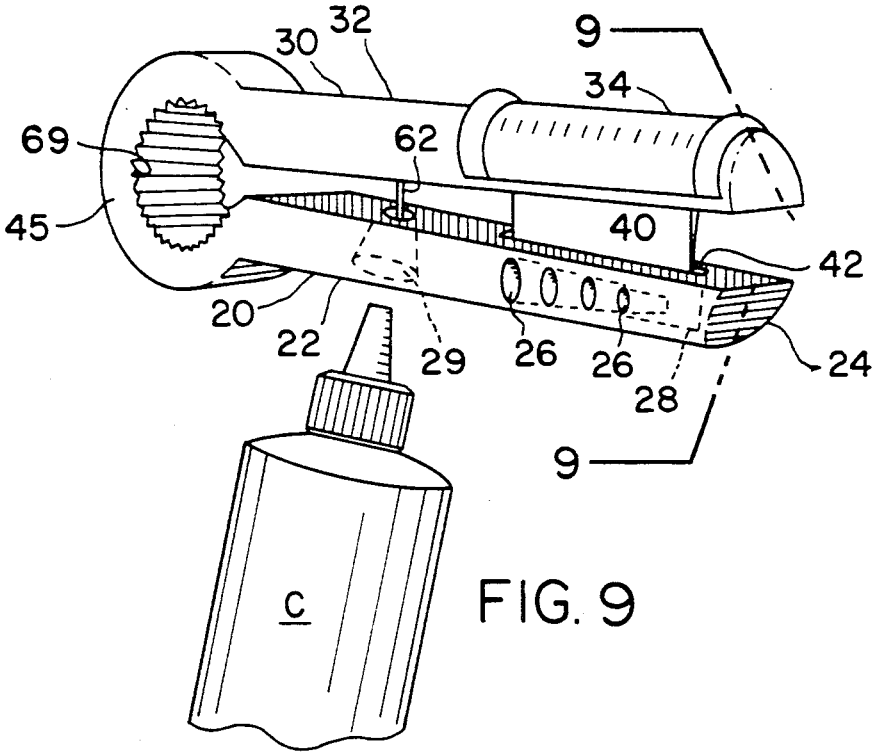
FIG. 9 is a perspective view of a third embodiment of the present invention showing a bottle being opened using the puncture means.
Figure 10:
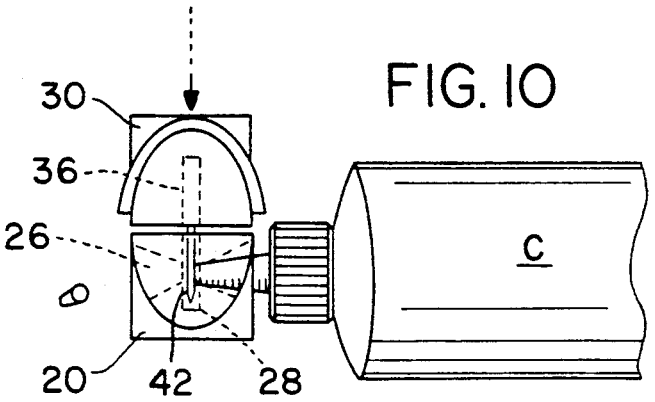
FIG. 10 is an end view of a third embodiment of the present invention shown in the cutting mode.

A third embodiment of the invention is shown in FIGS. 8 through 10. This embodiment, although intended to be a dispensable unit, includes features which may be included in the first and second embodiments which have been discussed above. Wherever possible, reference numerals on components which have been previously discussed have been retained.

Referring now more particularly to the drawings and specifically to FIGS. 8 through 10, a third embodiment of the bottle opener of the present invention is therein depicted. The bottle opener 10 comprises a pair of substantially similar arms 20,30. The arms are preferably manufactured out of flexible, resilient plastics such as those discussed, supra.

The first arm 20 has a proximal end 22 and a distal end 24 and includes a plurality of spaced apart apertures 26 that extend transversely therethrough. The first arm 20 is an elongate section of plastic approximately 3–5 inches in length. A slot 28 extends longitudinally along the first arm 20 and is defined by the apertures 26 between opposing sides of the first arm. The apertures 26 are located on the first arm 20 in the forward portion thereof and extend transverse to the longitudinal axis of the arm. Depending on the user's requirements, the bottle opener 10 of the present invention may include from one to several apertures which may also vary in diameter.

As previously mentioned, the first arm 20 includes a slot 28 extending longitudinally along it's central portion. The slot 28 is defined by the apertures 26 between opposing sides of the first arm. As illustrated, the slot 28 is long enough to accommodate the entire length of a cutting blade means 40 or razor blade and has a depth that allows the razor blade to traverse the aperture having the largest diameter. The first arm also includes a cone-shaped bore 29 which extends through the first arm perpendicular thereto (as best shown in FIGS. 8 and 9). The function of the bore 29 will become apparent as the specification proceeds.

The second arm 30 also includes a second proximal end 32 and a second distal end 34. A groove means 36 or groove extends longitudinally along the second ar and is adapted to mount a cutting blade means 40 having a cutting edge 42. In the embodiment as shown in FIGS. 8 through 10, the cutting blade means 40 comprises a conventional industrial razor that is designed to be mounted within the groove 36. The second arm 30 also includes a centrally located L-shaped bore 41 that is adapted to receive a puncture means 62 which takes the form of an L-shaped pin that extends down into the second arm 20, as will be explained in detail hereinbelow.

The proximal ends 22,32 of the respective first and second arms are joined together and form a substantially circular living hinge 45 which includes a cap gripping means 60 in the form of a series of serrations extending transverse to the longitudinal axis of the apparatus. Of course, the cap gripping means could take other forms than those shown, such as protuberances, raised points, serrations in other directions, or a combination of the foregoing.

The bottle opener 10 is fabricated by using standard molding techniques, well-known to those skilled in the molding arts. More specifically, the bottle opener 10 is molded in two parts (along line 9—9 of FIG. 9), each section including one-half of each of arms 20,30 and one-half of cap gripping means 69 and hinge 45. Each half includes depressions for receiving the cutting means 40 and puncture means 62, which are manually inserted. The two halves are then connected together by means of screws (not shown), ultrasonic welding (well known to those skilled in the art), or by other suitable means. The arms 20,30 are molded so that they are normally biased apart into the inoperative mode wherein the cutting edge 42 of the cutting blade means 40 is positioned within slot 28, but not blocking the apertures 26. When the first and second arms are urged together into a cutting mode, the cutting edge 42 of the cutting means is moved into a cutting position that traverses the aperture 26. Similarly, when the arms 20,30 ar ®urged together, the puncture means 62 reciprocates within the cone-shaped bore 29.

The operation of the apparatus is identical to that of the embodiments previously discussed and the reader is referred thereto for a thorough discussion thereof.

The foregoing embodiments and examples are to be considered illustrative rather than restrictive of the invention, and those modifications which come within the meaning and range of equivalence of the claims are to be included therein.

That which is claimed is:

1. A bottle opener for cutting open bottle caps and comprising:

a first arm having a proximal end and a distal end, said first arm including a transverse aperture, and further including a slot extending longitudinally along said first arm and being defined by said aperture between opposing sides of said first arm;

a second arm having a second proximal end and a second distal end, said second arm mounting a cutting blade means having a cutting edge, said first and second arms being joined together at their respective proximal ends and being normally urged apart into an inoperative mode wherein said cutting edge of said cutting blade means is positioned within said slot and when urged together into a cutting mode said edge means is moved into a cutting position that traverses said aperture, whereby when a bottle cap is placed within said aperture when said first and second arms are in the inoperative mode and when said first and second arms are moved to the cutting mode, the edge means moves into cutting contacting relation with the bottle cap and thereby cuts open the bottle cap.

2. The bottle opener according to claim 1 wherein said cutting blade means comprises a razor blade.

3. The bottle opener according to claim 2 wherein said razor blade is removable.

4. The bottle opener according to claim 1 further including a gripping means operatively associated with each of said distal end and said second distal end of the respective first and second arms.

5. The bottle opener according to claim 4 further including a puncture means connected to one of said arms beneath said gripping means, said gripping means being movable from a first inoperative position wherein said puncture means is hidden to a second puncturing position wherein said puncture means is exposed.

6. The bottle opener according to claim 1 wherein one of said arms includes a bore defining a channel, and wherein the other of said arms includes an elongate puncture means connected to said other arm and mounted for reciprocating movement within said bore so that when the first and second arms are in the inoperative mode, the puncture means is in a first retracted position and when the first and second arms are urged together into the cutting mode, the puncture means is moved to a second extended position.

7. A bottle opener for cutting open bottle caps and comprising:

a first arm having a proximal end and a distal end, said first arm including a plurality of spaced apart apertures extending transversely therethrough, and further including a slot extending longitudinally along said first arm and being defined by said aperture between opposing sides of said first arm;

a second arm having a second proximal end and a second distal end, said second arm;

mounting a cutting blade means having a cutting edge;

said first and second arms being movably joined together at their respective proximal ends and being normally urged apart into an inoperative mode wherein said cutting edge of said cutting blade is positioned within said slot and when urged together into a cutting mode, said cutting edge is moved into a cutting position that traverses said apertures, whereby when a bottle cap is placed within one of said apertures, when said first and second arms are in the inoperative mode and when said first and second arms are moved to the cutting mode, the cutting blade means moves into cutting contacting relation with the bottle cap and thereby cuts open the bottle cap.

8. The bottle opener according to claim 7 wherein said first and second arms comprise a flexible plastic.

9. The bottle opener according to claim 7 further including a hinge means movably connecting said first and second arms together, said hinge means being located proximate the respective proximal ends of each of said arms.

10. The bottle opener according to claim 8 further including a hanging means connected to one of the respective arms.

11. The bottle opener according to claim 7 wherein said cutting blade means comprises a razor blade.

12. The bottle opener according to claim 11 wherein said second arm includes a longitudinally extending groove means adapted to interchangeably mount a razor blade.

13. The bottle opener according to claim 7 further including a gripping means operatively associated with each of said distal end and said second distal end of the respective first and second arms.

14. The bottle opener according to claim 13 further including a puncture means connected to one of said arms beneath said gripping means, said gripping means being movable from a first inoperative position wherein said puncture means is hidden to a second puncturing position wherein said puncture means is exposed.

15. The bottle opener according to claim 7 wherein one of said arms includes a bore defining a channel proximate the proximal end thereof, and wherein the other of said arms includes an elongate puncture means connected to said other arm proximate the proximal end thereof, said puncture means reciprocally extending into said bore so that when the first and second arms are in the inoperative mode, the puncture means is in a first retracted position and when the first and second arms are urged together into the cutting mode, the puncture means is moved to a second extended position.

wherein the other of said arms includes an elongate puncture means connected to said other arm proximate

16. A bottle opener for cutting open bottle caps and comprising:

a first arm having a proximal end and a distal end, said first arm including a plurality of spaced apart apertures extending traversely therethrough, and further including a slot extending longitudinally along said first arm and being defined by said apertures between opposing sides of said first arm;

a second arm having a second proximal end and a second distal end, said second arm including a cutting blade means having a cutting edge;

said first and second arm being movably joined together at their respective proximal ends and being normally urged apart into an inoperative mode wherein said cutting edge of said cutting blade means is positioned within said slot and when urged together into a cutting mode the cutting edge of said cutting means is moved into a cutting position that traverses said aperture;

whereby when a bottle cap is placed within said aperture when said first and second arms are in the inoperative mode and when said first and second arms are moved to the cutting mode, the cutting blade means moves into cutting contacting relation with the bottle cap and thereby cuts the bottle cap.

17. The bottle opener according to claim 16 further including a gripping means operatively associated with each of said distal end and said second distal end of the respective first and second arms.

18. The bottle opener according to claim 17 further including a puncture means connected to one of said arms beneath said gripping means, said gripping means being movable from a first inoperative position wherein said puncture means is hidden to a second puncturing position wherein said puncture means is exposed.

19. The bottle opener according to claim 16 wherein one of said arms includes a bore defining a channel proximate the distal end thereof, and wherein the other of said arms includes an elongate puncture means connected to said other arm proximate the distal end thereof, said puncture means reciprocally extending into said bore so that when the first and second arms are in the inoperative mode, the puncture means is in a first retracted position and when the first and second arms are urged together into the cutting mode, the puncture means is moved to a second extended position.

20. The bottle opener according to claim 1 further including cap gripping means for holdingly gripping a bottle cap to be removed, said cap gripping means being associated with the respective proximate ends of each of said first and second arms.

21. The bottle opener according to claim 20 wherein said cap gripping means comprises a circular opening having a serrated surface adapted to grip and hold a bottle cap.

* * * * *